US011189938B2

(12) United States Patent
Au

(10) Patent No.: US 11,189,938 B2
(45) Date of Patent: Nov. 30, 2021

(54) LOW PROFILE END-FIRE ANTENNA ARRAY

(71) Applicant: T-Mobile USA, Inc., Bellevue, WA (US)

(72) Inventor: Chad Au, Kirkland, WA (US)

(73) Assignee: T-Mobile USA, Inc., Bellevue, WA (US)

( * ) Notice: Subject to any disclaimer, the term of this patent is extended or adjusted under 35 U.S.C. 154(b) by 59 days.

(21) Appl. No.: 16/802,334

(22) Filed: Feb. 26, 2020

(65) Prior Publication Data

US 2020/0194903 A1 Jun. 18, 2020

Related U.S. Application Data

(63) Continuation of application No. 15/683,737, filed on Aug. 22, 2017, now Pat. No. 10,615,515.

(51) Int. Cl.

| | |
|---|---|
| ***H01Q 21/08*** | (2006.01) |
| ***H01Q 1/42*** | (2006.01) |
| ***H01Q 9/30*** | (2006.01) |
| ***H01Q 3/26*** | (2006.01) |
| ***H01Q 3/08*** | (2006.01) |

(Continued)

(52) U.S. Cl.

CPC ..... *H01Q 21/08* (2013.01); *H01Q 1/1228* (2013.01); *H01Q 1/1242* (2013.01); *H01Q 1/42* (2013.01); *H01Q 3/06* (2013.01); *H01Q 3/08* (2013.01); *H01Q 3/2617* (2013.01); *H01Q 3/30* (2013.01); *H01Q 9/30* (2013.01); *H01Q 1/246* (2013.01)

(58) Field of Classification Search

CPC .... H01Q 1/1242; H01Q 1/1228; H01Q 1/125; H01Q 1/42; H01Q 1/246; H01Q 3/2617; H01Q 3/08; H01Q 3/06; H01Q 3/30; H01Q 3/34; H01Q 9/30; H01Q 21/08; H01Q 1/12; H01Q 1/005; H01Q 1/1207; H01Q 1/1214; H01Q 1/1221; H01Q 1/1264; H01Q 1/428; H01Q 3/02; H01Q 3/04; H01Q 19/30; H01Q 19/32; H01Q 21/12; H01Q 21/067; H01Q 21/068

See application file for complete search history.

(56) References Cited

U.S. PATENT DOCUMENTS

| | | | |
|---|---|---|---|
| 6,111,550 | A | 8/2000 | Miller et al. |
| 7,642,988 | B1 | 1/2010 | Johnson et al. |

(Continued)

*Primary Examiner* — Robert Karacsony

(74) *Attorney, Agent, or Firm* — Lee & Hayes, P.C.

(57) ABSTRACT

Low-profile end-fire antenna systems to provide additional throughput in areas of need with minimal structural and aesthetic impact. The system can include one or more low-profile end-fire antennas mounted to an exterior surface (e.g., a roof or parapet) of a building, parking deck, exiting cell tower, water tower, or other suitable structure. Additional electronics can be remotely mounted to maintain the low profile of the system. The system can be color-matched, or otherwise camouflaged, to maintain building aesthetics. The low-profile end-fire antenna can be mounted on a positioning stand to enable the elevation and/or azimuth of the system to be adjusted. The low profile of the antennas can reduce wind loading and enable the system to be mounted to existing structures without reinforcement, or other modification, to the structure. The orientation of the system relative to observers in many locations (e.g., on the ground) renders the system all but invisible.

20 Claims, 12 Drawing Sheets

(51) Int. Cl.

| | |
|---|---|
| ***H01Q 3/06*** | (2006.01) |
| ***H01Q 3/30*** | (2006.01) |
| ***H01Q 1/12*** | (2006.01) |
| ***H01Q 1/24*** | (2006.01) |

(56) References Cited

U.S. PATENT DOCUMENTS

| | | | | |
|---|---|---|---|---|
| 10,615,515 | B2 * | 4/2020 | Au | H01Q 3/08 |
| 2019/0067792 | A1 | 2/2019 | Au | |

* cited by examiner

LOW PROFILE END-FIRE ANTENNA ARRAY

RELATED APPLICATIONS

This application is a continuation of and claims priority to U.S. patent application Ser. No. 15/683,737, filed on Aug. 22, 2017, the disclosure of which is incorporated by reference herein.

BACKGROUND

Cellular and other wireless networks are capable of sending and receiving frequencies used for data and voice communications, among other things. These voice and data connections are generally sessions originated at a central switch center and transported via fiber optic cable to a radio base station (e.g., eNodeB, or eNB) for LTE or other wireless technology and propagated by the use of antennas. A majority of these antennas are mounted on traditional cell towers (also known as macro cells), but can also include other antenna shapes or be in the form of mini cells, micro wireless devices, and other technologies. In densely populated areas, such as large urban centers, the throughput required by users can outpace the throughput capacity provided by large cell towers.

The number of conventional cell towers in a given location is also often limited by local zoning codes, space availability, and the capital investment required to install a cell tower. Installing a standard cell tower, for example, can cost from several hundred thousand dollars to millions of dollars. In addition, many people do not want a cell tower installed near them because they believe them to be an eyesore, among other things. Unfortunately, cellular devices, such as cellular phones, smart phones, and tablet computers, for example, have relatively limited ranges over which they can send and receive cellular signals. Thus, cell towers must be relatively close together to provide sufficient coverage and the desired throughput.

Almost by definition, however, in urban locations, buildings, parking decks, and similar structures are plentiful, with buildings almost touching in many locations. Many of these structures could serve as installation locations for cell site equipment. Installing a large cell tower on existing structures, however, can require reinforcement of the structure, bracing, power upgrades, and other modifications, which increases costs and may affect the life of the building, among other things. As mentioned above, placing a cell tower on top of a building may also be locally opposed for aesthetic, and other, reasons. In addition, in many locations, placing a cell tower on top of a building, for example, may provide reduced throughput simply because the signals are blocked by the building itself and surrounding buildings.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

As mentioned above, the number of cell towers, or "macro sites," capable of handling a large amount of cellular throughput may be limited by zoning, topographical, aesthetic, loading, and other considerations. Other technologies exist that can be used to "fill the gaps." Micro-, pico- and femptocells, for example, are small cellular transceivers that can be installed in areas of high traffic to provide additional connectivity for cellular user to the cellular backbone. Indeed, a variety of small cellular transceivers, antenna arrays, and other equipment can be installed on streetlights, billboards, and other structures for this purpose.

For simplicity and clarity, the sometimes ambiguous terms "bandwidth" and "throughput" will be used in different, and specific ways, herein. The term bandwidth will be used to specifically refer to the band of frequencies over which the antenna can functionally operate. Throughput, on the other hand, will be used to specifically refer to the amount of data that can be transferred (e.g., the number of bits being streamed per unit time) by a particular system or component thereof.

In general, depending on the antenna design, the throughput provided by a particular flat panel antenna array is governed by the number of radiating elements, or monopoles, included in the antenna array and the number of antennas. The size (length) of the monopoles, however, is closely related to the frequency band within which the antenna is intended to operate. Thus, for a given frequency (or rather, wavelength) the length of each monopole is relatively fixed if optimum efficiency is desired. In many cases, shorter elements can be used to reduce antenna size or to increase the number of radiating elements, but at the expense of some efficiency.

Figure 1:
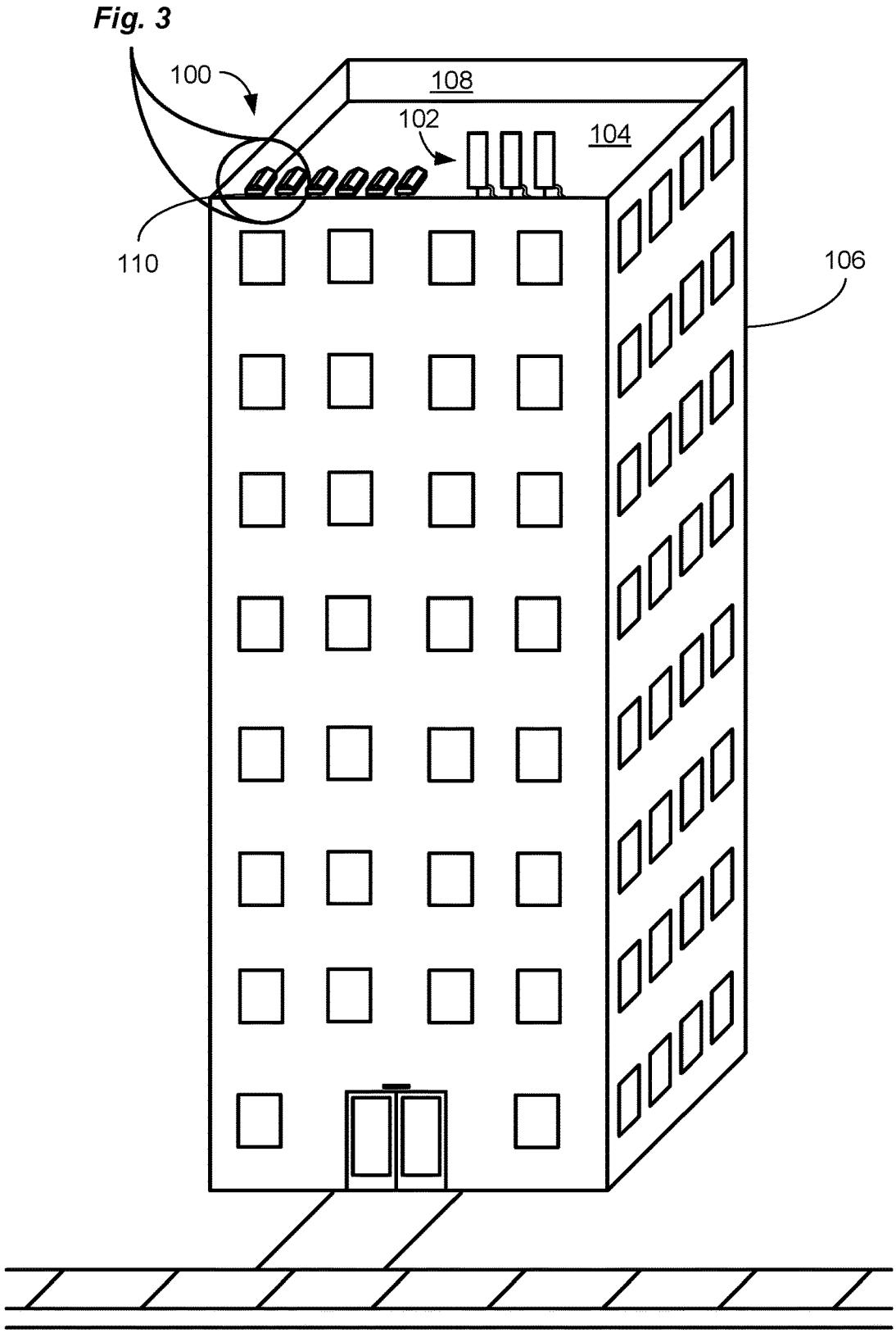
FIG. 1 depicts an example of both a panel antenna array and a low-profile end-fire antenna system mounted to a building, in accordance with some examples of the present disclosure.

Thus, one way of increasing the throughput of an antenna array is to increase the number of monopoles in each antenna and/or increasing the number of separate antennas in the antenna array. As shown in FIG. 1, from several standpoints, having large, broadside antenna panels 102 mounted on the roof 104 of a building 106 can be undesirable, however. For performance reasons, for example, the antennas 102 are often mounted above the parapet 108 of the building 106 to avoid the parapet 108 blocking the signals from the antennas 102. As such, the antenna panels 102 interrupt the shape of the building and may upset what are otherwise clean lines on the building 106. In addition, the larger the antennas 102, the larger the sail area, and the larger the structure required to support the antennas 102. Thus, large antennas 102 may require additional superstructure, building reinforcement, and other modifications to support their weight and resist wind forces, among other things.

To this end, examples of the present disclosure can comprise systems and methods for providing low-profile end-fire antennas 110 on buildings 106 and other structures. The low-profile end-fire antennas 110 can be mounted on the roof of the building 106, for example, but due to their design are substantially less visible than the aforementioned panel antennas 102. As discussed below with reference to FIG. 2, because only the end of the antenna 110 is visible from below, the low-profile end-fire antennas 110 are barely visible from the street level.

In some examples, the low-profile end-fire antennas 110 can also be designed to mimic features on the building 106 proximate the mounting location. Thus, the low-profile end-fire antennas 110 may form the merlons of a crenellated wall, for example, or another architectural feature. In addition, the low-profile end-fire antennas 110 can be colored to match the mounting location (e.g., concrete, brick, or painted surfaces) to further camouflage their existence.

Figure 2:
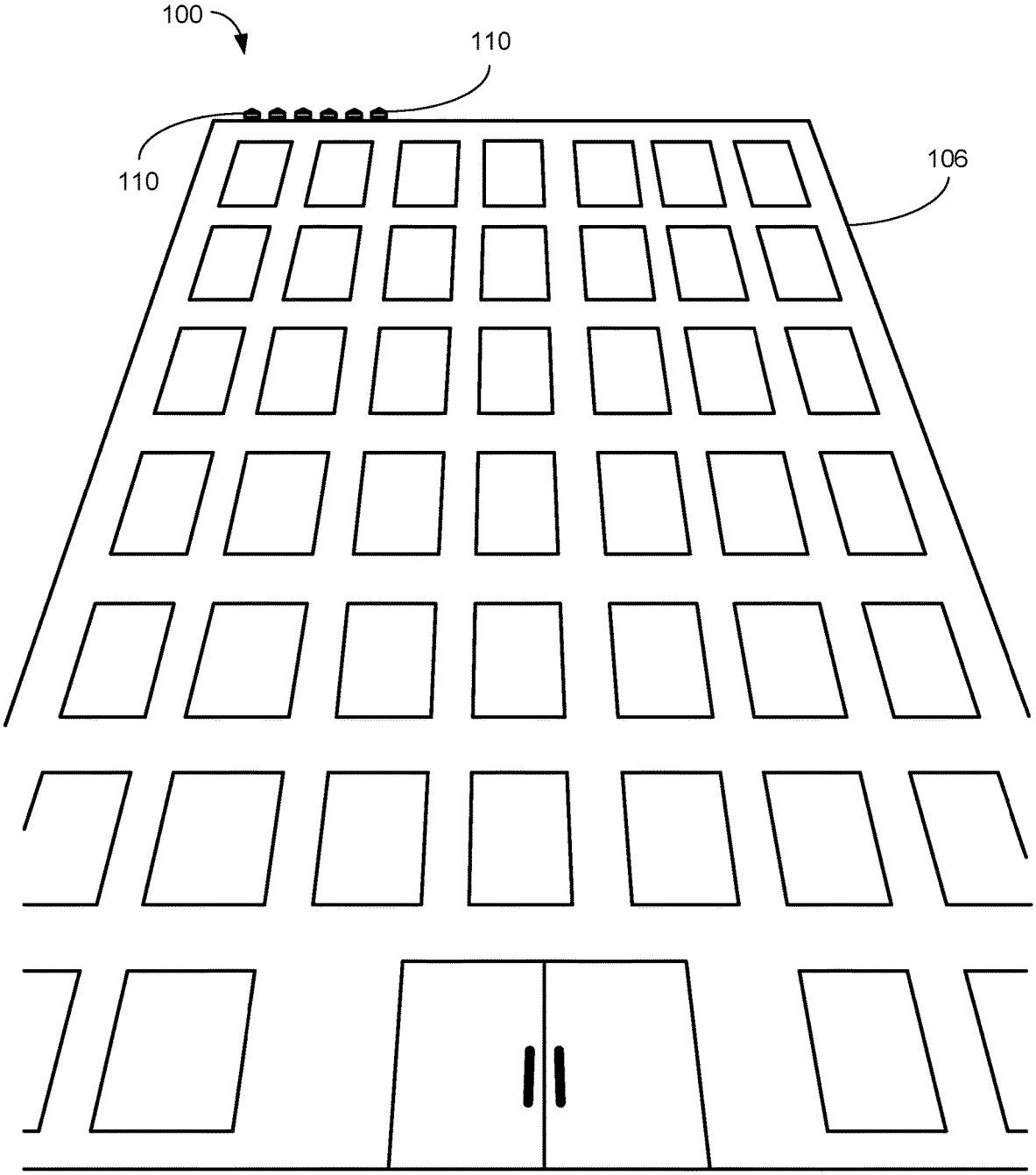
FIG. 2 is a perspective view of the low-profile end-fire antenna system from the ground level, in accordance with some examples of the present disclosure.

As shown in FIG. 2, because only the ends of the low-profile end-fire antennas 110 are visible, the visual impact on the building 106 is greatly reduced. In addition, as discussed below, in many cases, the low-profile end-fire antennas 110 are pointed downward to focus their coverage (i.e., the direction of maximum radiation) toward the ground, rather than up in the air. In this manner, the visual impact for the observer on the ground may be further reduced because the low-profile end-fire antennas 110 are essentially "pointed" at the observer. From the ground, therefore, the observer may see essentially a pure end view of the antenna 110, or the minimum profile of the antenna 110, further minimizing the visibility of the low-profile end-fire antennas 110.

Figure 3:
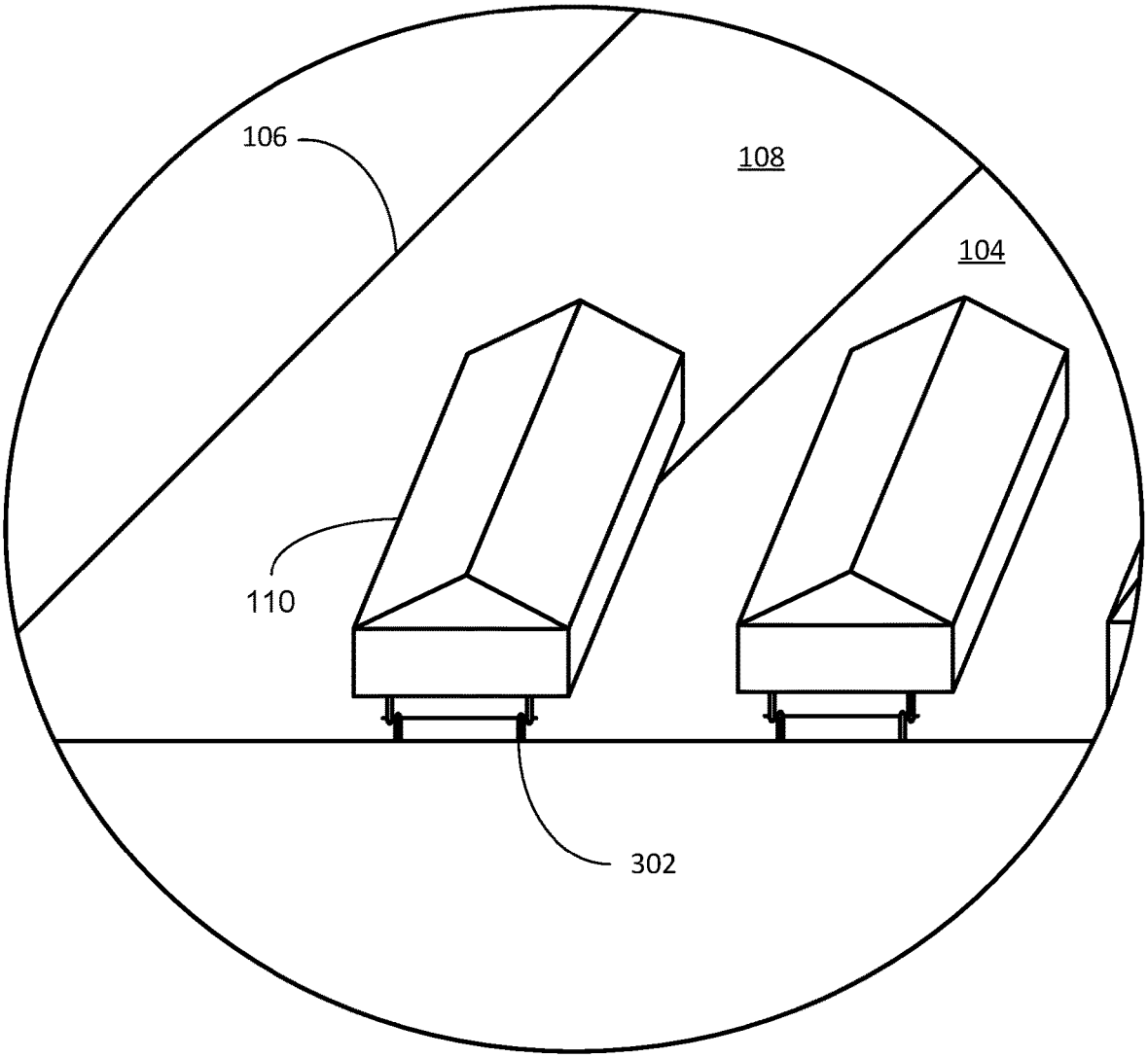
FIG. 3 is a detailed view of the low-profile end-fire antenna system of FIG. 1, in accordance with some examples of the present disclosure.

As shown in more detail in FIG. 3, each of the low-profile end-fire antennas 110 can be mounted on the roof 104, above the parapet 108, to provide a substantially unobstructed view outward from the building. In some examples, each low-profile end-fire antenna 110 can be mounted on a positioning stand 302 to enable the low-profile end-fire antenna 110 to be aimed as desired. In some examples, the positioning stand 302 can enable the antenna 110 to be tilted up and down to change the elevation of the antenna 110. In other examples, the positioning stand 302 can also enable the antennas 110 to be pivoted to change the azimuth of the antennas 110. This can enable the antennas 110 to be aimed at the ground and/or aimed at a particular location (e.g., a park or a transit station) where extra throughput is desired.

Figure 4A:
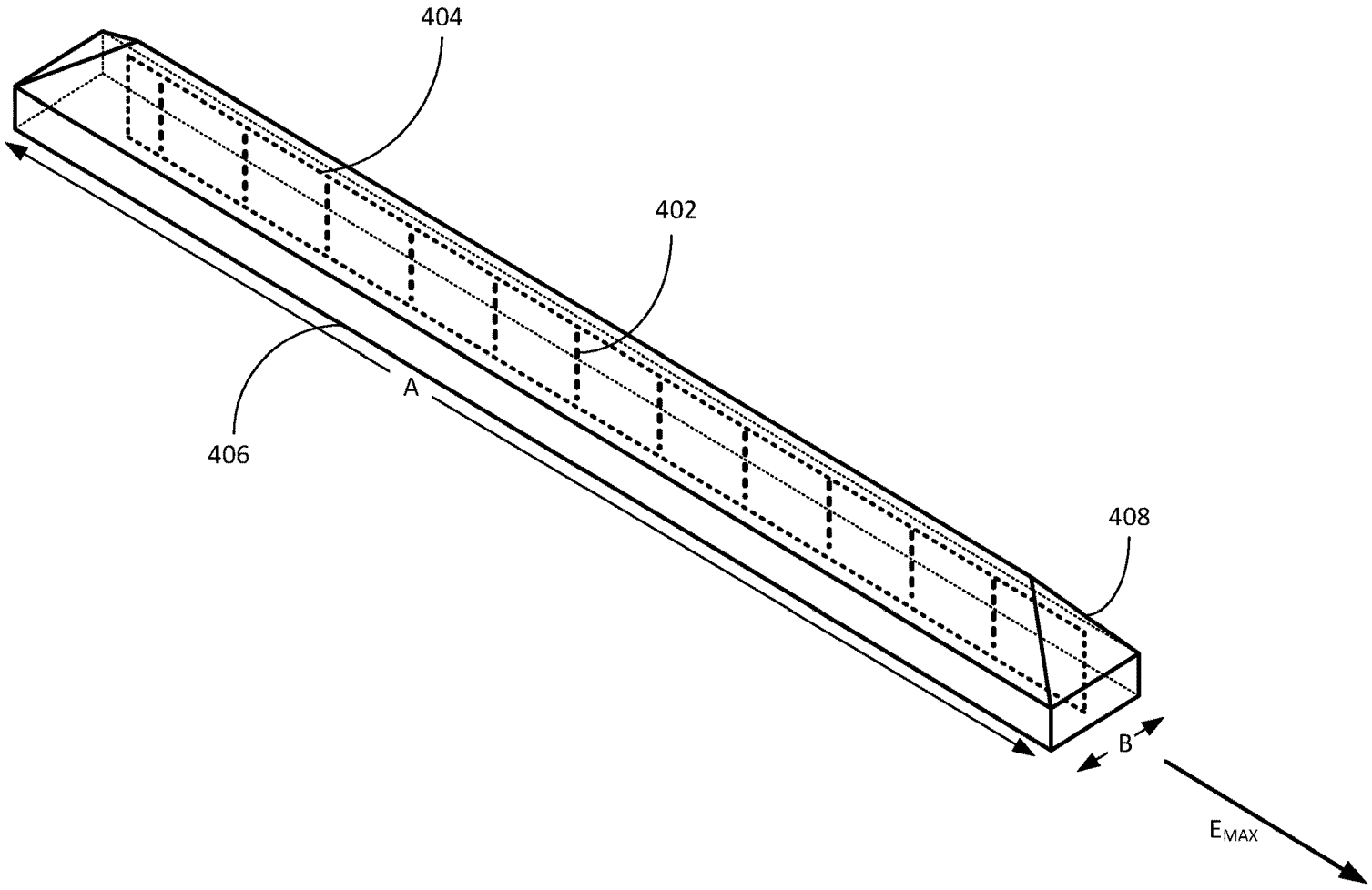
FIG. 4A is a perspective view of an example of a low-profile end-fire antenna for use with the system of FIG. 1, in accordance with some examples of the present disclosure.
Figure 4B:
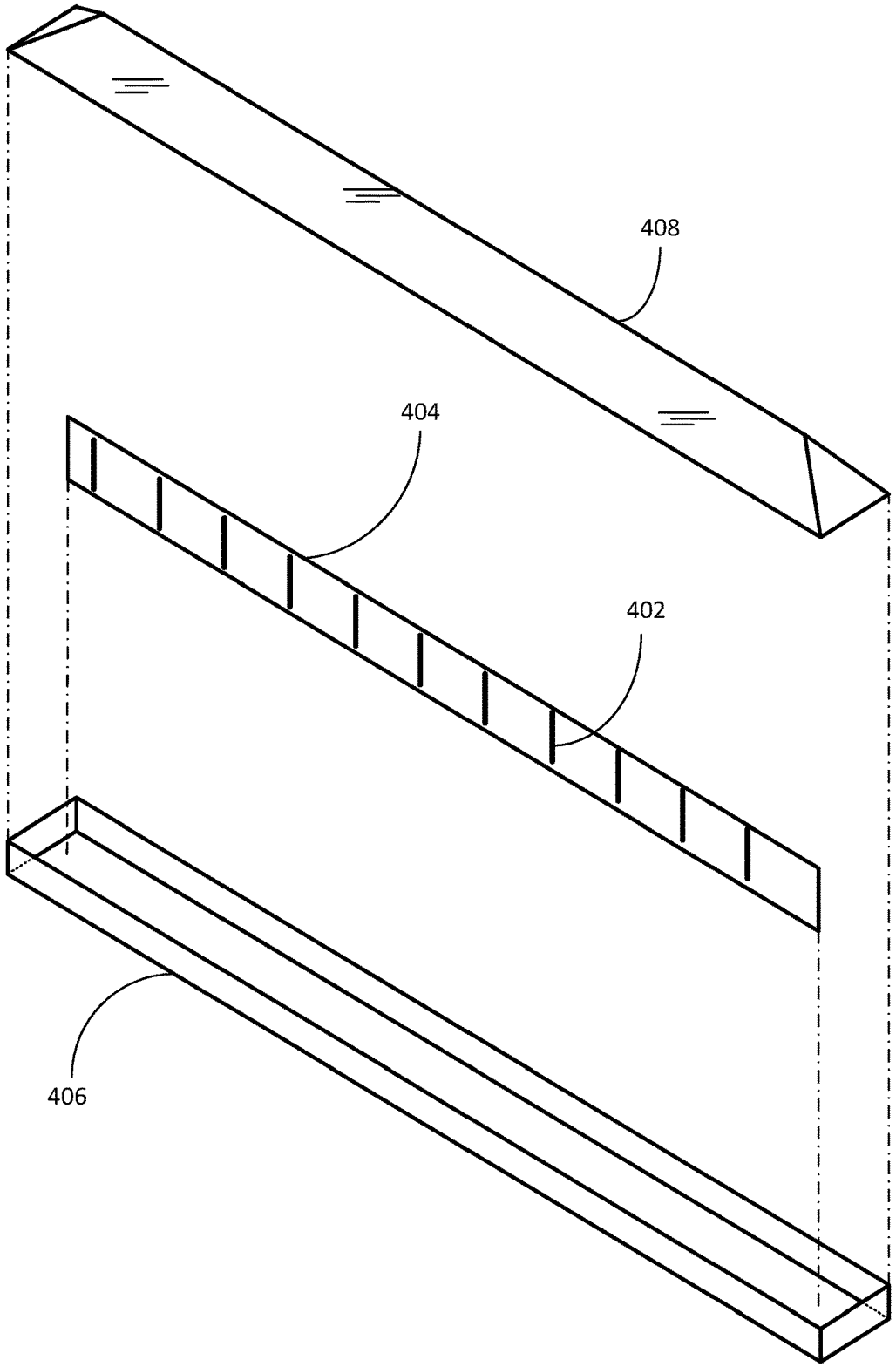
FIG. 4B is an exploded view of the example of the low-profile end-fire antenna of FIG. 4A, in accordance with some examples of the present disclosure.

As shown in FIGS. 4A and 4B, the low-profile end-fire antennas 110 can each comprise a plurality of monopoles (or other radiating elements) 402 mounted over a ground plane 404. The ground plane 404 and elements 402, in turn, can be mounted inside a case 406 and covered with a radome 408. Due to phasing of the radiating elements 402 (discussed below), the direction of maximum radiation, $E_{MAX}$, is substantially in line with the monopoles 402, though other ground plane orientations could be used to effect slightly different radiation patterns. In some examples, horizontal dipoles (with horizontal polarization) can also be positioned above the ground plane 404 with similar effect.

Regardless of configuration, the radome 408 can be transparent to RF-transmissions (though not necessarily transparent to light). The radome 408 can also be conveniently shaped and/or coated (e.g., with a hydrophobic finish) to shed water and debris. The radome 408 can comprise a pyramid, for example, with the forward face 410 tilted back to further reduce the end profile. The radome 408 could also be a bubble or half-pipe, however, like many sky lights, or any other shape suitable to shed water and debris. This can reduce the maintenance for the antennas 110 by reducing, or eliminating, the need to periodically clean the radomes 408.

The natural radiation pattern for the low-profile end-fire antennas 110 is, as the name implies, off the end, or forward face 410, of the antenna. The coverage provided is generally on the order of 15-20° in elevation and 60-65° in azimuth. In some examples, to steer, broaden, or narrow this beam, the forward face 410 of the radome 408 can also comprise a lens. In other words, instead of being purely transparent to RF transmissions, the radome 408 can include dielectric materials with varying density across the forward face 410, metamaterials, or isotropic graded refractive index (GRIN) materials, for example, to "physically" steer the beam from the antenna 110. Thus, while phase shifting can produce the end-fire aspect of the antenna 110, the lens can provide steering (left or right, up or down) in addition to the physical adjustment provided by the positioning stand 302.

The operating frequency of the antennas 110 can be adjusted by adjusting the size of the monopoles 402. In general, the length of the monopoles 402 should be approximately one-quarter the length of the wavelength (or, $\lambda/4$) at the desired frequency. For 600-700 MHz transmissions, a common cellular band, for example, the monopoles 402 should be approximately 4.5" (i.e., $r=(\lambda/4)\approx 18/4$). Indeed, a single antenna 110 can operate at multiple frequencies by including different length monopoles 402 along the ground plane 404 with sets of monopoles 402 dedicated to different bands of frequencies. If the monopoles are tuned for uplink and downlink frequencies, their feeds can then be shared using a duplexer 204, as previously discussed.

Figure 5A:
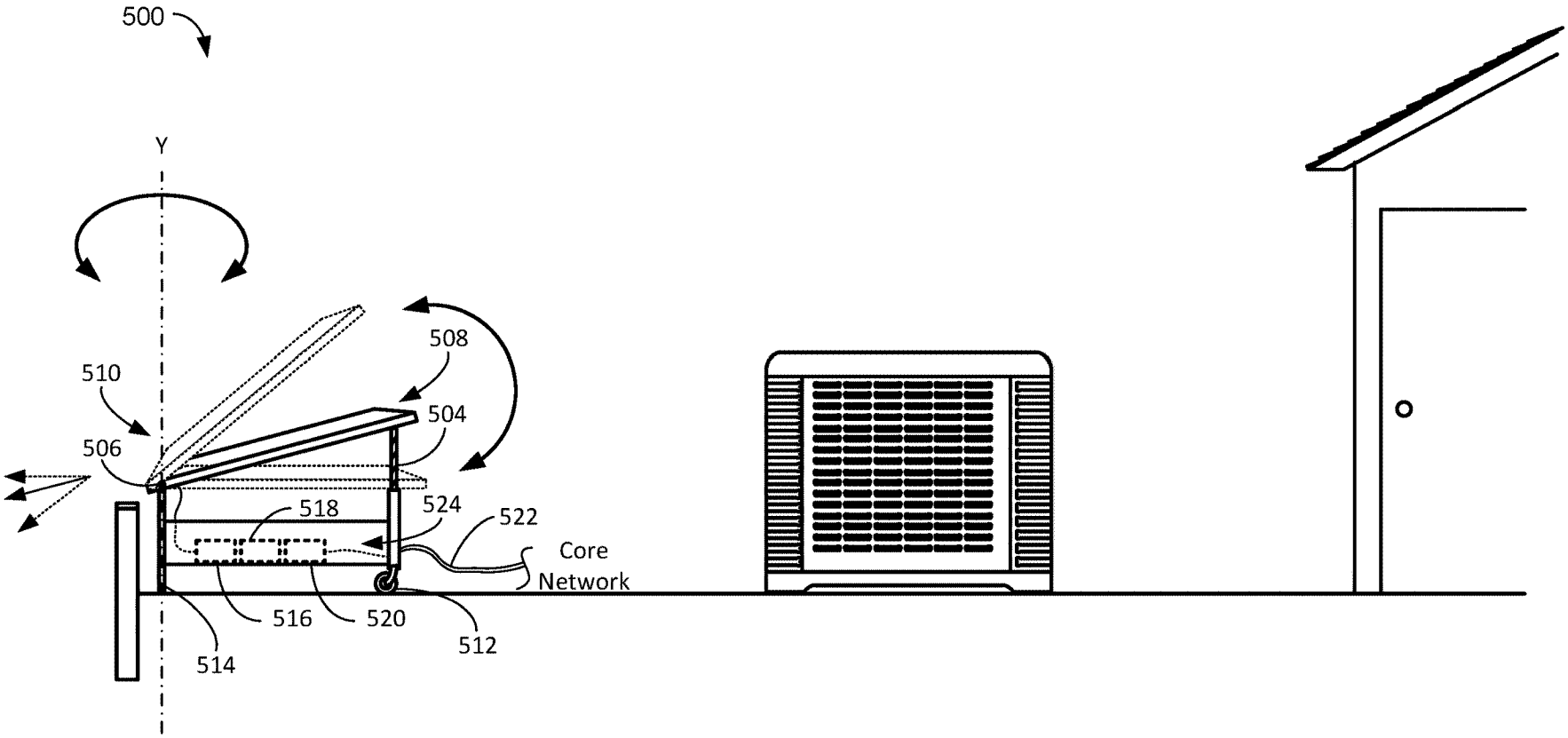
FIG. 5A is a side view of an example of the low-profile end-fire antenna with a positioning stand in a roof-mounted configuration, in accordance with some examples of the present disclosure.

As shown in FIG. 5A, the low-profile end-fire antennas 110 can be mounted on the roof 104, terraces, or other convenient location on the building. Moreover, as discussed below with respect to FIG. 5C, low-profile end-fire antennas 110 can also be used on towers and other structures to reduce the separation needed between radiation centers, among other things. Due to the relatively directional nature of the low-profile end-fire antennas 110, however, it may be desirable to be able to tilt and/or pivot the low-profile end-fire antennas 110 to adjust the elevation and /or azimuth, respectively, of the coverage provided by the antennas 110. To this end, examples of the present disclosure can also comprise an adjustable low-profile end-fire antenna system 500. As shown, in some examples, the low-profile end-fire antennas 110 can be mounted on the positioning stand 302. The positioning stand 302 can include a tilting mechanism 504 and a pivot 506 to enable the low-profile end-fire antenna 110 to be tilted up or down. This can enable the low-profile end-fire antenna 110 to be aimed at the ground, for example, or at a particular level in a nearby building (e.g., a convention level at a hotel) to provide additional throughput to a specific location.

The tilting mechanism 504 can comprise a suitable mechanism to raise and lower the rear 508 and/or raise and lower the front 510 of the low-profile end-fire antenna 110 to point the antenna 110 towards the desired location. To this end, if the antenna 110 is to be aimed at the street below the building 106 to provide coverage in a busy pedestrian area, for example, then the tilting mechanism 504 can raise the rear 508 and/or lower the front 510 of the antenna 110. Conversely, if the antenna 110 is to provide coverage to a busy conference level in a nearby building (e.g., a hotel) on a higher floor, then the tilting mechanism 504 can raise the front 510 and/or lower the rear 508 of the antenna 110.

The tilting mechanism 504 can comprise a screw jack (shown), linear actuator, hydraulic ram, or other suitable mechanism to raise and lower the rear 508 of the antenna 110. In some examples, the front 510 of the antenna 110 can include a simple pivot 506. In other examples, the front 510 of the antenna 110 can also include a separate tilting mechanism 504 (not shown) similar to the tilting mechanism 504 shown. Thus, the system 500 can include multiple screw jacks, rams, etc. depending on the desired adjustability. Indeed, in some examples, the system 500 can include a tilting mechanisms at each corner of the positioning stand 302 to enable the antenna to be tilted up and down and even diagonally. In any case, the elevation of the antenna 110 can be changed to affect the area of coverage for the antenna 110.

In some examples, in addition to providing elevation adjustments, the positioning stand 302 can also enable azimuth adjustments. The tilting mechanism 504 can be mounted on a caster 512, for example, to enable the antenna 110 to be pivoted around a front support 514 that is pivotally coupled to the building 106. In this manner, the antenna 110 can be pivoted about the front support 514 (i.e., about the y-axis). Depending on the location of the system 500 relative to the parapet 108, the antenna 110 can be pivoted 180 degrees or more. The caster 512 can be locking, for example, to enable the position of the antenna 110 to be fixed and to prevent antenna 110 movement due to wind, weather, and other forces.

In some examples, the positioning stand 302 can enable the azimuth and elevation of the antenna 110 to be adjusted remotely. This can enable the service provider to fine tune the antenna's position based on performance metrics, for example, and to re-aim the antenna 110 based on changing demand or weather conditions, among other things. In some examples, the tilting mechanism 504 and caster 512 can include a servo motor, linear actuator, or another actuator, and a controller 516.

The controller 516 can include a transceiver to enable the controller 516 to send and receive information, including remote control inputs from the service provider, or another source. In some examples, the controller 516 can utilize the same connection to the cellular backbone that is used by the antennas 110. In other examples, the controller 516 can use a separate, dedicated communications connection (e.g., a separate coaxial, fiber optic, or RF connection). The controller 516 may use Antenna Interface Standards Group (AISG) standard communications, for example, which includes a plurality of open specifications for the control interface for a variety of Antenna Line Devices (ALDs).

Thus, in some examples, the controller 516 may receive instructions to change the position of the antenna 110 in response to data related to the metrics of the antenna 110 (e.g., usage, signal strength, etc.). In other examples, the controller 516 can include embedded logic to make these adjustments automatically based on data from the antenna(s) 110. In still other examples, the controller 516 can receive, or include, instructions to move to different positions based on the time of day. In the morning, the antenna(s) 110 can be pointed at a busy transit station, for example, while at night they can be pointed at a strip of night clubs and restaurants.

In some examples, as discussed in more detail below with reference to FIG. 5B, the system 500 can also include a duplexer 518 in communication with the antennas 110 a plurality of cables 520. The duplexer 518 can enable unwanted frequencies to be filtered out to differentiate between uplink and downlink frequencies, for example, or simply to reduce signal noise. In some examples, the system 500 can also include a phase shifter 522 to provide the desired end-fire effect and/or to further steer the beam, as desired (e.g., the beam may be able to be steered upward slightly from the antenna 110).

In some examples, the system 500 can also include a weather resistant enclosure 524. The enclosure 524 can be included as part of the positioning stand 302 (FIG. 5A) or can be a separate component on the roof 104 (FIG. 5B). As the name implies, the enclosure 524 can provided protection from the elements and may also include climate control (e.g., air conditioning and heat) to protect the electronics associated with the duplexer 518, phase shifter 522, modems, and other equipment, though this is not generally necessary with modern electronics, which are very robust and designed to withstand a wide range of conditions.

Figure 5B:
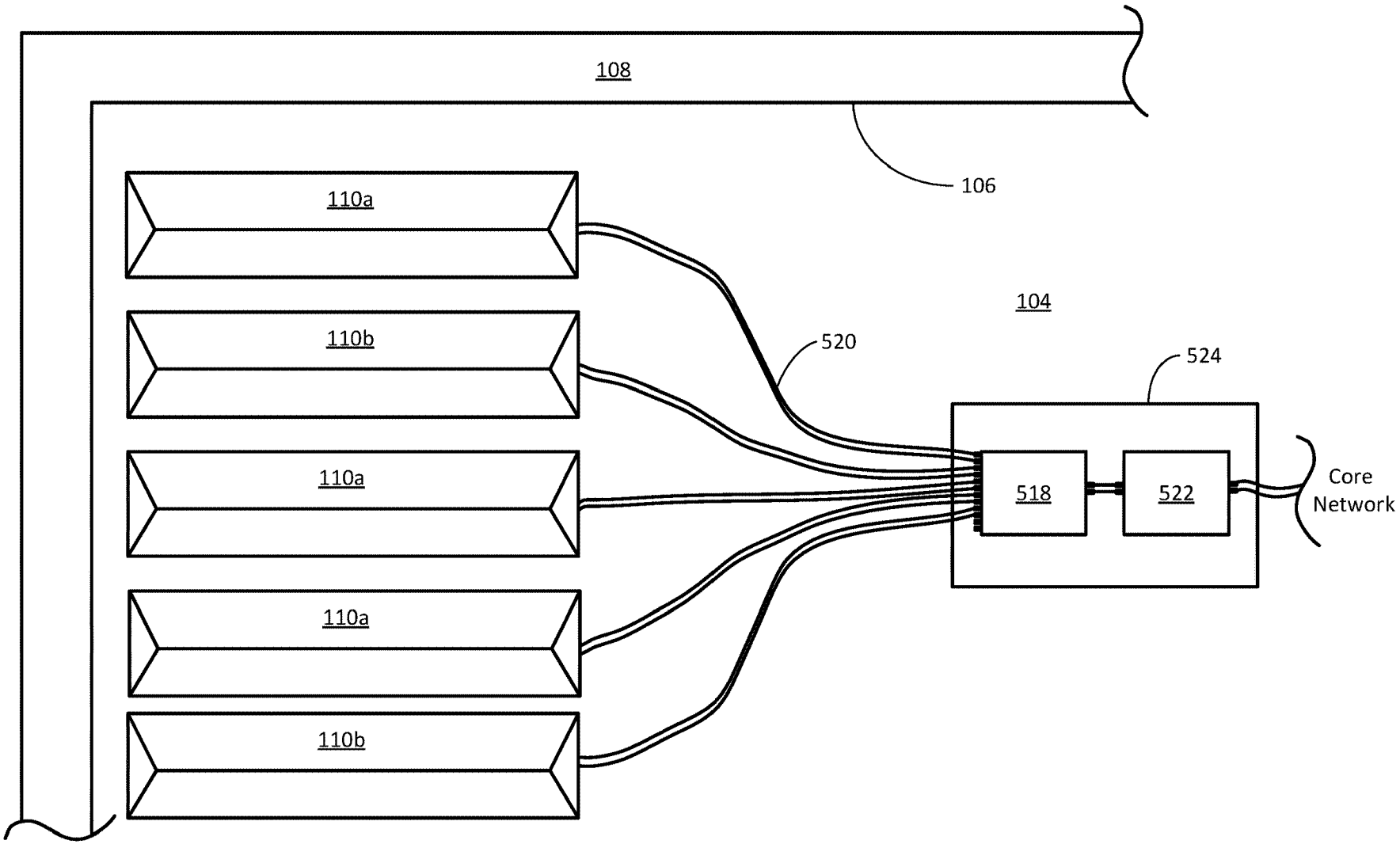
FIG. 5B is a top view of the example of the low-profile end-fire antenna in the roof-mounted configuration, in accordance with some examples of the present disclosure.

As shown in FIG. 5B, the system 100 can comprise a plurality of low-profile end-fire antennas 110, each with a plurality of radiating elements, or monopoles, 202 configured to send and/or receive at one or more frequencies. In some examples, the system 100 can include a plurality of uplink antennas 110*a* designed to receive at cellular uplink frequencies (e.g., 1710-1755 MHz) and plurality of downlink antennas 110*b* designed to send at downlink frequencies (e.g., 2110-2155 MHz). The configuration of the antennas 110 (e.g., how many uplink 110*a* vs. downlink 110*b* antennas) are in the array can be determined based on usage, or another metric. As shown, it is also somewhat immaterial how the uplink 110*a* and downlink 110*b* antennas are arranged (e.g., alternating, random, etc.).

As mentioned above, due to the (at least) two operating frequencies and possible RF interference from other sources, the system 100 can also include one or more duplexers 518. The duplexer 518 can be used to separate out the various frequencies to enable duplex communications. Because the relatively high-powered downlink frequencies (e.g., the signal being sent from the network to the user equipment (UE)) have a tendency to "drown-out" the weaker uplink frequencies (from the UE to the base station), for example, the duplexer 518 can be used to isolate the uplink frequencies and filter out the downlink frequencies, and vice versa. The duplexer 518, in turn, can be connected to a transceiver connected to the cellular backbone via one or more backhaul facilities (e.g., Ethernet, microwave, etc.).

Generally, duplexers 518 are relatively bulky, however. As a result, in some configurations, the duplexer 518 can be remotely mounted on the roof 104, positioning stand 302, or another location, and connected to the system 100 via the one or more cables 520 (e.g., coaxial cables). In this manner, this visible portion of the system 100—the low-profile end-fire antenna 110—can be thin and light, especially when compared to an antenna with an internal duplexer 518. In some examples, as discussed in more detail below, the system 100 can also include one or more phase shifters 522 to provide the end-fire feature of the antennas 110. Ultimately, the system 100 can be connected via an RF-compatible cable 520 to the cellular backbone. As mentioned above, the system 100, 500 enables targeted increases in throughput in busy or underserved areas with minimal structural and aesthetic impact to the mounting structure (e.g., the building 106).

Figure 5C:
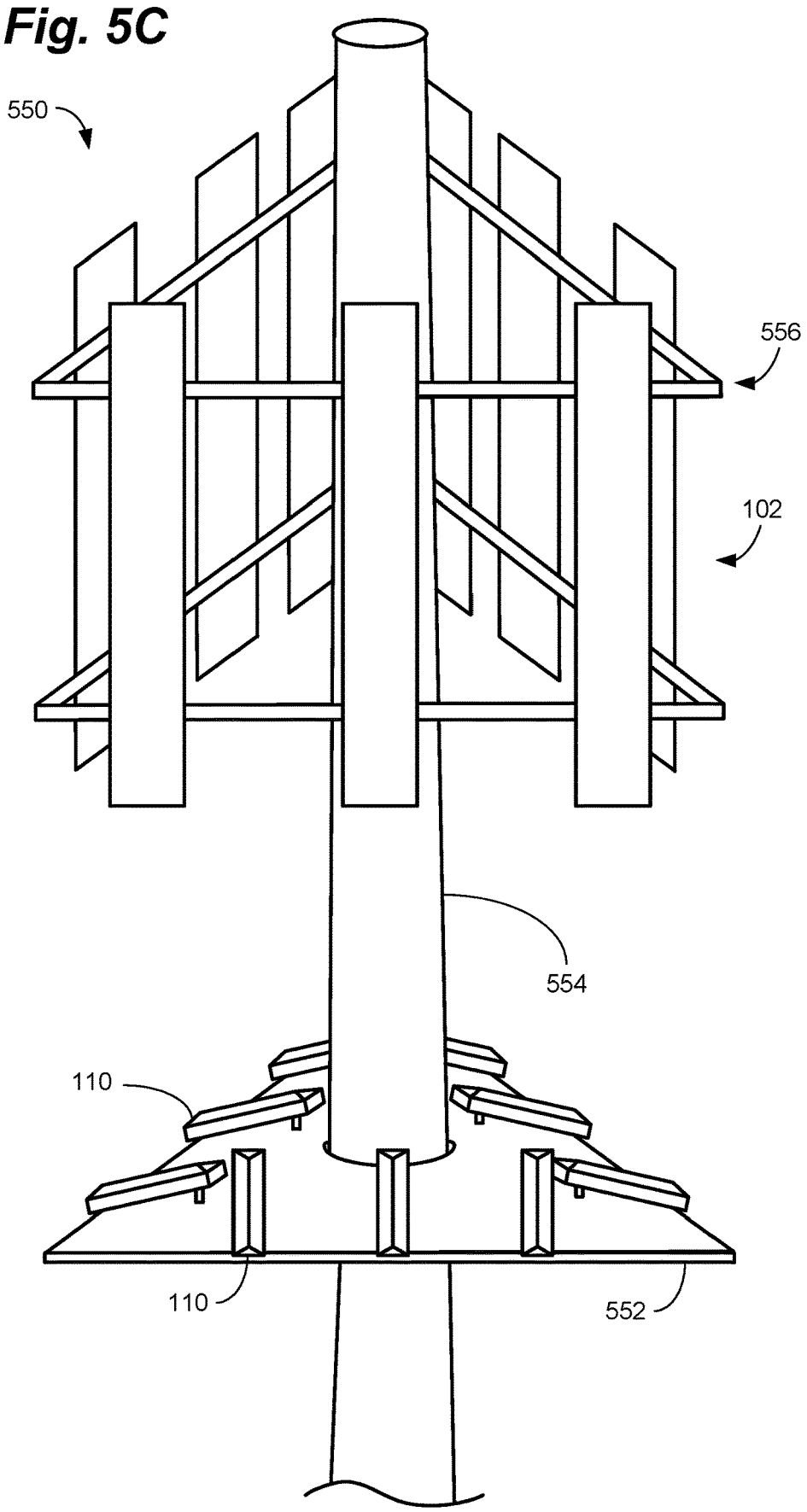
FIG. 5C is a top perspective view of the example of the low-profile end-fire antenna in a tower-mounted configuration, in accordance with some examples of the present disclosure.

As shown in FIG. 5C, the low-profile antennas 110 can be used in many locations where additional and/or targeted coverage is desired. To this end, examples of the present disclosure can also comprise a tower-mounted system 550 to provide increased throughput, reduce wind loading, and/or reduce the separation needed between radiation centers (e.g., other antennas). This may be useful in proximity to certain structures and in areas that may be at capacity using conventional broadside antennas 102. The low-profile end-fire antennas 110 can be aimed to provide targeted coverage in specific locations, for example, such as auditoriums and meeting halls where user concentration (and thus, demand for throughput) is very high. In addition, the low-profile end-fire antennas 110 can increase site throughput, while reducing the increases in wind loading that would be caused by additional flat-panel antennas 102.

To this end, in some examples, the low-profile end-fire antennas 110 can be mounted on a platform 552 attached to a conventional cell tower 554. The low-profile end-fire antennas 110 can be mounted below the flat panel, or broad side, antennas 102, as shown, above the flat panel antennas 102, or, space permitting, on the same superstructure 556 as the flat panel antennas 102. In some examples, the low-profile end-fire antennas 110 can be arrayed around the platform 552 in a substantially symmetrical manner to provide relatively even coverage over the area around the cell tower 554. In other examples, each low-profile end-fire antenna 110 can be aimed separately to provide targeted coverage to areas of need (e.g., parks, office building, convention centers, etc.).

In still other examples, as discussed above, each of the low-profile end-fire antennas 110 can be separately and/or remotely adjustable to provide specific coverage. Thus, in some examples, each of the low-profile end-fire antennas 110 can be aimed at a different elevation and azimuth based on the demand proximate the tower 554. Indeed, the low-profile end-fire antennas 110 can be remotely aimed to enable the array to meet changing demand proximate the tower 554 throughout the day, week, or month, for example. Some, or all, of the low-profile end-fire antennas 110 can be aimed to cover a convention one day, a ball game the next, and a park on the weekends.

Figure 6A:
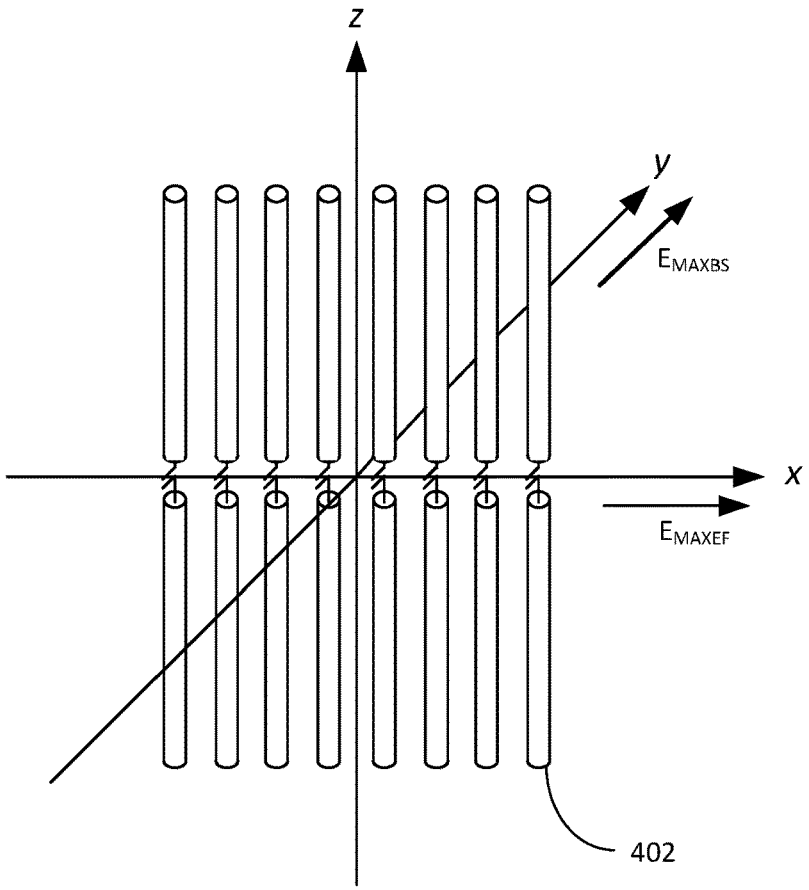
FIG. 6A is a perspective view schematic comparing the direction of maximum radiation from a panel antenna to the direction of maximum radiation for an end-fire antenna, in accordance with some examples of the present disclosure.
Figure 6B:
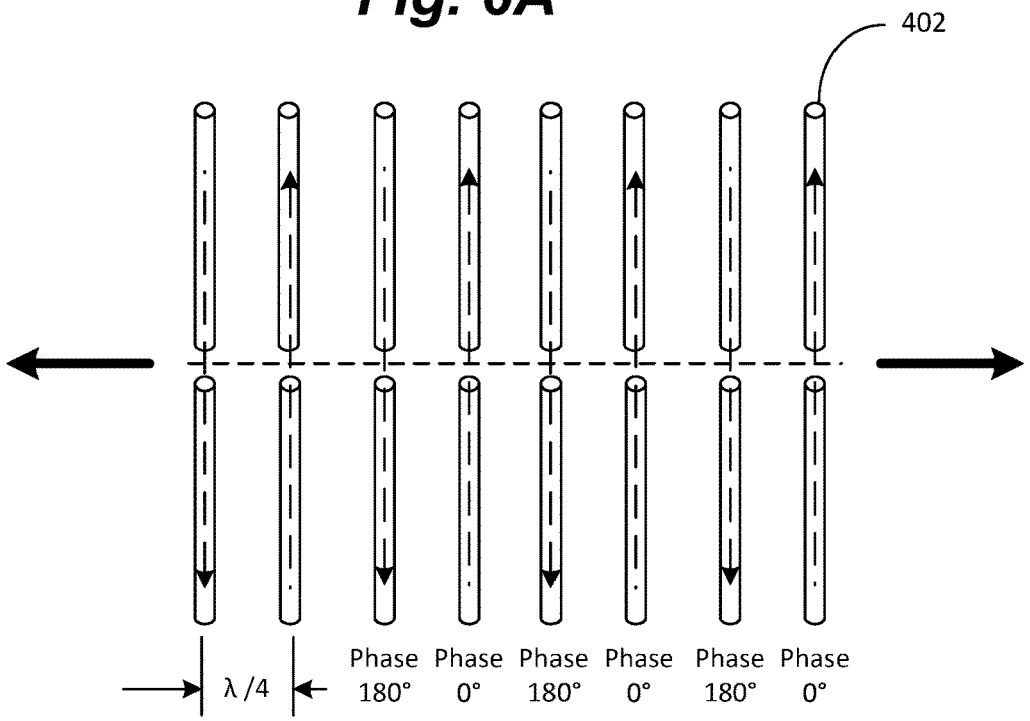
FIG. 6B is a side view schematic showing the phasing and direction of maximum radiation for an end-fire antenna, in accordance with some examples of the present disclosure.

As shown in FIGS. 6A and 6B, the low-profile end-fire antenna 110 can use signal phasing to provide the desired radiation pattern. In a conventional broad-side antenna 102, the direction of maximum radiation, $E_{MAXBS}$, is perpendicular to the monopoles 402, or broadside. The low-profile end-fire antenna 110 differs from the broadside array 102 in that the monopole 402 spacing and phase distribution are such that radiation cancels in the broadside direction and sums parallel to the monopoles 402, or along the X-axis in FIG. 6A, maximizing response. The direction of maximum radiation, $E_{MAXEF}$, can be design to be bi-directional along the X-axis or in one direction only (shown). In the aforementioned case, where the antennas 110 are pointed down at the ground, for example, it may be useful to have $E_{MAXEF}$ in one direction (towards the ground). In other words, in the other direction, the signal is aimed up and may be unusable, unless, for example, there are taller buildings proximate the antenna 110 on the upward facing side of the antenna 110.

As shown in FIG. 6B, by designing the spacing of the monopoles 402 and controlling the phase at which each monopole 402 transmits, beam steering can enable the low-profile end-fire antenna 110 to work. As shown, the monopoles 402 are preferably space at approximately one quarter the wavelength, or $\lambda/4$, of the transmit and/or receive frequency for the low-profile end-fire antenna 110, though this can be adjusted somewhat if necessary at the expense of some efficiency. In addition, the monopoles 402 are made to radiate in an alternating out of phase pattern (e.g., 0-180-0-180, etc.). This creates the aforementioned cancellations and summations to provide end-fire radiation in the direction of $E_{MAXEF}$.

In some examples, rather than steering the beam to be fully parallel to the monopoles 402, the beam can be steered somewhere in between $E_{MAXBS}$ and $E_{MAXEF}$. In other words, by manipulating the phasing of the monopoles 402, the beam may be steered slightly upward, right or left, depending on the orientation of the monopoles (e.g., horizontal or vertical). This may enable the beam to be steered slightly in one direction without requiring, or in conjunction with, physical repositioning via the positioning stand 302.

Figure 7:
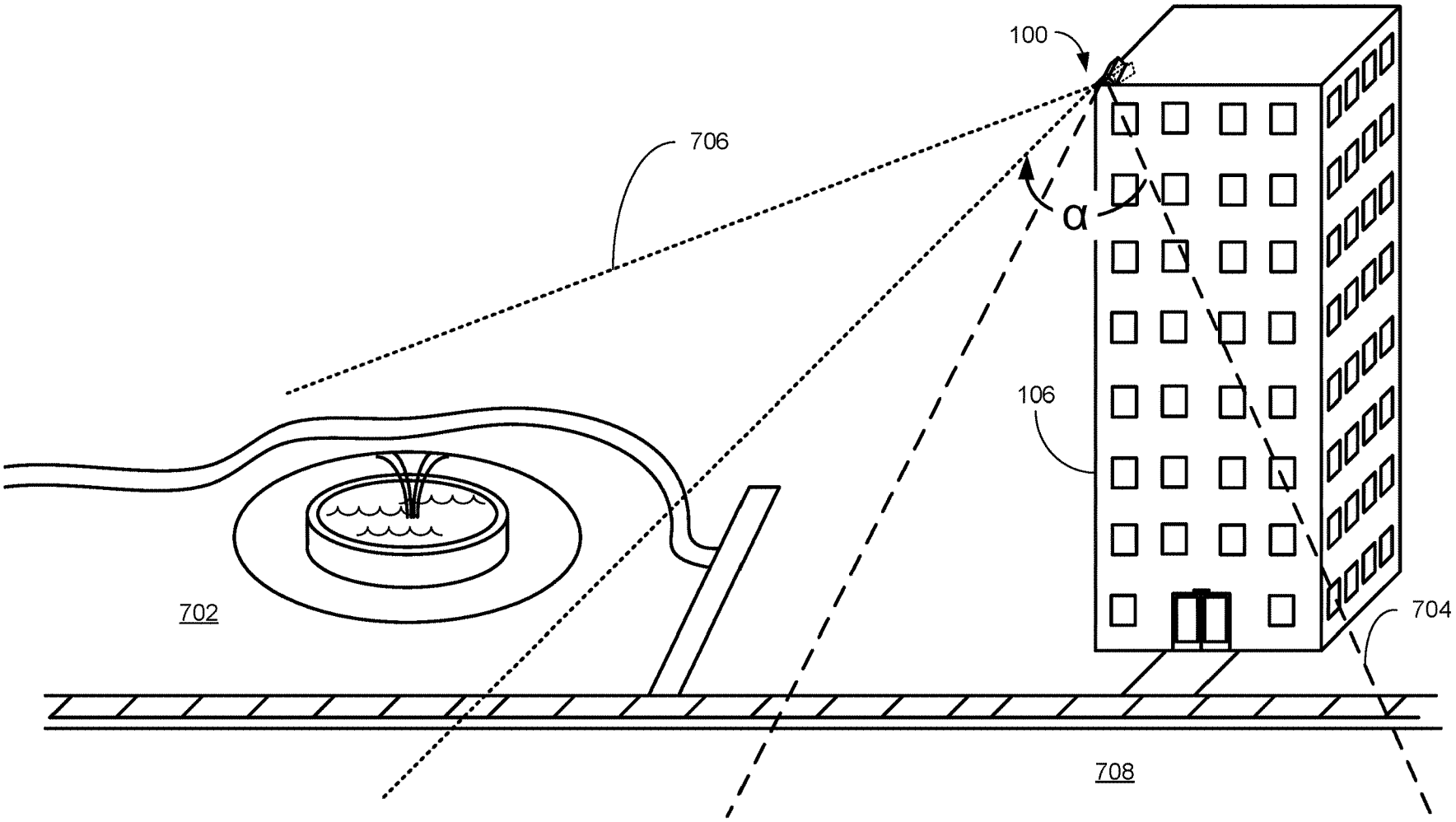
FIG. 7 depicts different areas of coverage provided by the system by adjusting the azimuth and/or elevation of an adjustable low-profile end-fire antenna system, in accordance with some examples of the present disclosure.

As shown in FIG. 7, the adjustability of the system 100 can enable the system 100 to provide coverage to different areas at the same time using multiple antennas 110 pointed in different directions or by changing the direction of the antennas 110 at different times. This can enable coverage areas to be changed in response to changing demand, performance metrics, weather, and other factors. As shown, in some examples, the system 100 can be aimed at a street 708 proximate the building 106 during the workweek and at a park 702 on the weekends.

This can be achieved by simply rotating the low-profile end-fire antenna 110 as necessary—though angle $\alpha$, in this case—to move the coverage area from a first coverage area 704 to a second coverage area 706. In some cases, the elevation of the antenna 110 can also be changed to make the coverage area closer or farther away from the building, for example, or even at a level above the system 100 (e.g., to cover an adjacent, but taller building or convention center).

As mentioned above, changing the configuration of the system 100 can be achieved manually with a worker physically moving the antenna(s) 110, or remotely using the controller 516. In some examples, a worker at a central control can connect to the system 100 or the individual antennas 110 using a remote interface to reposition the antenna(s) based on demand, time of day, time of week, weather, performance, etc. In other examples, the antennas 110 can be repositioned automatically by the controller 516 (or remotely) to different configurations based on similar factors. So, the controller 516 may aim the antennas 110 differently in the morning to cover commuters, at lunch to cover the lunch crowd, and at night to cover a local bar and restaurant district.

In addition, while not shown in FIG. 7, the first coverage area 704 and the second coverage area 706 can also be covered simultaneously simply by using multiple antennas 110. In other words, the system 100 can include multiple antennas 110, with each antenna 110 or pair of antennas 110*a*, 110*b* having a different configuration—and thus, a different coverage area 704, 706. Indeed, due to their low profile and low visibility, the entire roofline of the building 106 can be lined with antennas 110 to provide increased throughput and coverage through 360-degrees around the building.

Figure 8:
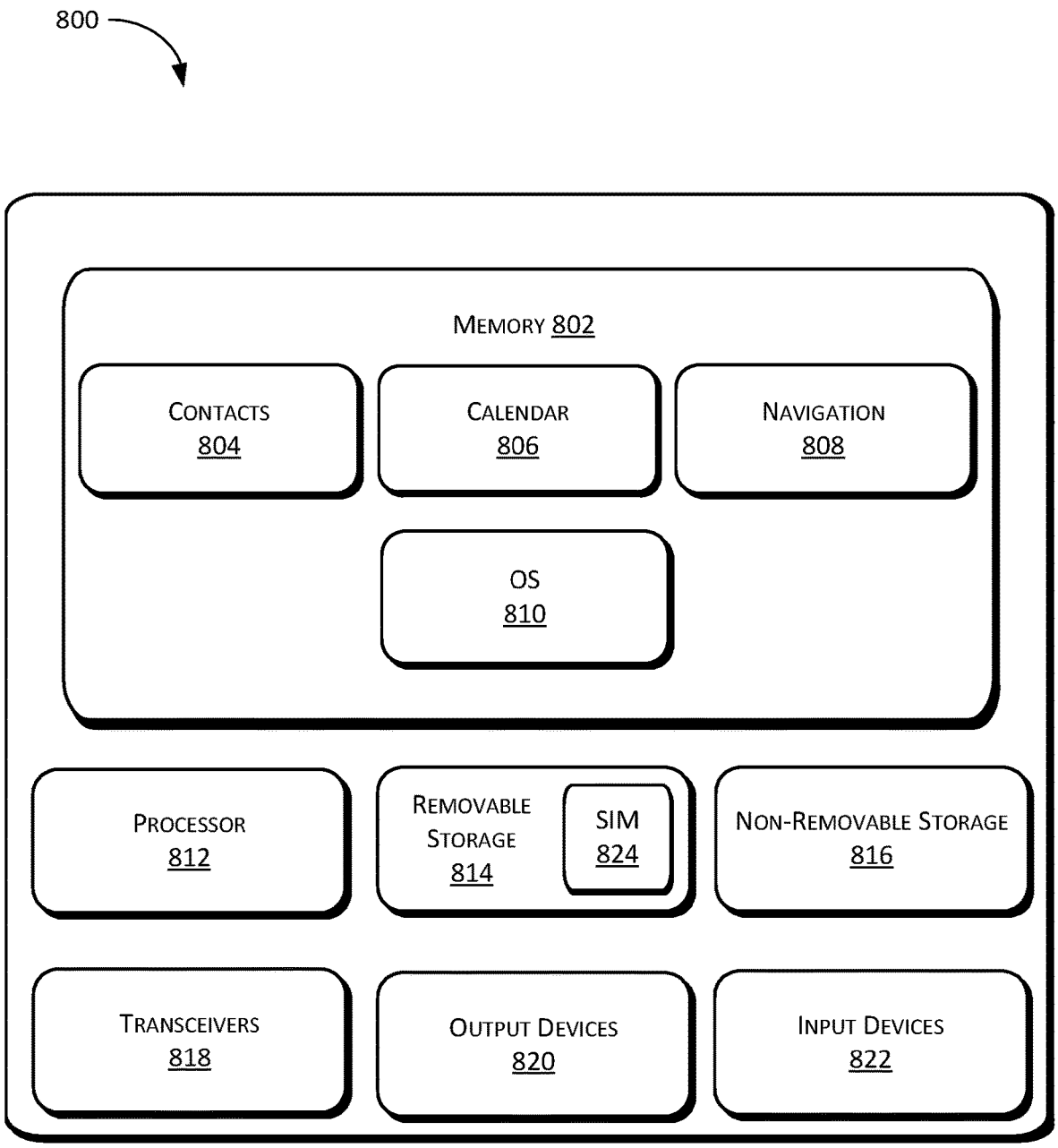
FIG. 8 is an example of an electronic device for use with the low-profile antenna system, in accordance with some examples of the present disclosure.

As shown in FIG. 8, the systems 100, 500 can include, and can be used in conjunction with, many electronic devices 800. The electronic device 800 can include for example, a cell phone or smart phone (i.e., user equipment, or UE), the aforementioned controller 516, duplexer 518, or phase shifter 522, or other components. Indeed, the electronic device 800 can include a variety of electronic devices such as, for example, tablet computers, laptops, desktops, and other network (e.g., cellular or IP network) connected devices from which a cellular voice and data can be accessed. Moreover, many devices capable of wireless and cellular communications (e.g., cellular, microwave, Wi-Fi, etc.) can be used with the systems 100, 500 described herein including the so-called "Internet of Things," to include appliances, cars, smart meters, and so on that access various wireless networks via the antennas 110. Indeed, the controller 516 and other components of the system 100, 500 may have direct network access to enable remote control, updates, and other features. All of these devices are referred to collectively below as an electronic device 800.

The electronic device 800 can comprise a number of components to provide wireless communications, applications ("apps"), internet browsing, remote control, and other functions. As discussed below, the electronic device 800 can comprise memory 802 including many common features such as, for example, the contacts 804, calendar 806, the operating system (OS) 808, and in the case of the controller 516, remote control 810.

The electronic device 800 can also comprise one or more processors 812. In some implementations, the processor(s) 812 is a central processing unit (CPU), a graphics processing unit (GPU), or both CPU and GPU, or any other sort of processing unit. The electronic device 800 can also include one or more of removable storage 814, non-removable storage 816, transceiver(s) 818, output device(s) 820, and input device(s) 822. In some examples, such as for cellular communication devices, the electronic device 800 can also include a subscriber identification module (SIM) 824 including an International Mobile Subscriber Identity (IMSI), and other relevant information.

In various implementations, the memory 802 can be volatile (such as random access memory (RAM)), non-volatile (such as read only memory (ROM), flash memory, etc.), or some combination of the two. The memory 802 can include all, or part, of the functions 804, 806, 810 and the OS 808 for the electronic device 800, among other things.

The memory 802 can comprise contacts 804, which can include names, numbers, addresses, and other information about the user's business and personal acquaintances, among other things. In some examples, the memory 802 can also include a calendar 806, or other software, to enable the user to track appointments and calls, schedule meetings, and provide similar functions. Of course, the memory 802 can also include other software such as, for example, e-mail, text messaging, social media, and utilities (e.g., calculators, clocks, compasses, etc.).

The memory 802 can also include the OS 808. Of course, the OS 808 varies depending on the manufacturer of the electronic device 800 and currently comprises, for example, iOS 10.3.2 for Apple products and Nougat for Android products. The OS 808 contains the modules and software that supports a computer's basic functions, such as scheduling tasks, executing applications, and controlling peripherals.

In the context of the controller 516, duplexer 518, and phase shifter 522, the electronic device 800 can also include a remote control module or app 810. The remote control 810 can enable a central control or worker, for example, to "dial-in" to the system 100, 500 via one or more transceivers 818 to make positional, frequency, or phase adjustments, provide updates, perform maintenance, and provide other function without having to be present at the antenna array. As mentioned above, this can enable the parameters of the system 100, 500 to be changed in response to performance issues, demand, or other factors. In some examples, the controller 516 and other components may conform to AISG communications protocols to standardize communications across platforms and locations.

The electronic device 800 may also include additional data storage devices (removable and/or non-removable) such as, for example, magnetic disks, optical disks, or tape. Such additional storage is illustrated in FIG. 8 by removable storage 814 and non-removable storage 816. The removable storage 814 and non-removable storage 816 can store some, or all, of the functions 804, 806, 810 and OS 808.

Non-transitory computer-readable media may include volatile and nonvolatile, removable and non-removable tangible, physical media implemented in technology for storage of information, such as computer readable instructions, data structures, program modules, or other data. The memory 802, removable storage 814, and non-removable storage 816 are all examples of non-transitory computer-readable media. Non-transitory computer-readable media include, but are not limited to, RAM, ROM, electronically erasable programmable ROM (EEPROM), flash memory or other memory technology, compact disc ROM (CD-ROM), digital versatile disks (DVD) or other optical storage, magnetic cassettes, magnetic tape, magnetic disk storage or other magnetic storage devices, or any other tangible, physical medium which can be used to store the desired information and which can be accessed by the electronic device 800. Any such non-transitory computer-readable media may be part of the electronic device 800 or may be a separate database, databank, remote server, or cloud-based server.

In some implementations, the transceiver(s) 818 include any sort of transceivers known in the art. In some examples, the transceiver(s) 818 can include wireless modem(s) to facilitate wireless connectivity with the other UEs, the Internet, and/or an intranet via a cellular connection. Further, the transceiver(s) 818 may include a radio transceiver that performs the function of transmitting and receiving radio frequency communications via an antenna (e.g., Wi-Fi or Bluetooth®). In other examples, the transceiver(s) 818 may include wired communication components, such as a wired modem or Ethernet port, for communicating with the other UEs or the provider's Internet-based network.

In some implementations, the output device(s) 820 include any sort of output devices known in the art, such as a display (e.g., a liquid crystal or thin-film transistor (TFT) display), a touchscreen display, speakers, a vibrating mechanism, or a tactile feedback mechanism. In some examples, the output devices can play various sounds based on, for example, whether the electronic device 800 is connected to a network, the type of call being received (e.g., video calls vs. voice calls), the number of active calls, etc. Output device(s) 820 also include ports for one or more peripheral devices, such as headphones, peripheral speakers, or a peripheral display.

In various implementations, input device(s) 822 include any sort of input devices known in the art. For example, the input device(s) 822 may include a camera, a microphone, a keyboard/keypad, or a touch-sensitive display. A keyboard/keypad may be a standard push button alphanumeric, multi-key keyboard (such as a conventional QWERTY keyboard), virtual controls on a touchscreen, or one or more other types of keys or buttons, and may also include a joystick, wheel, and/or designated navigation buttons, or the like.

Figure 9:
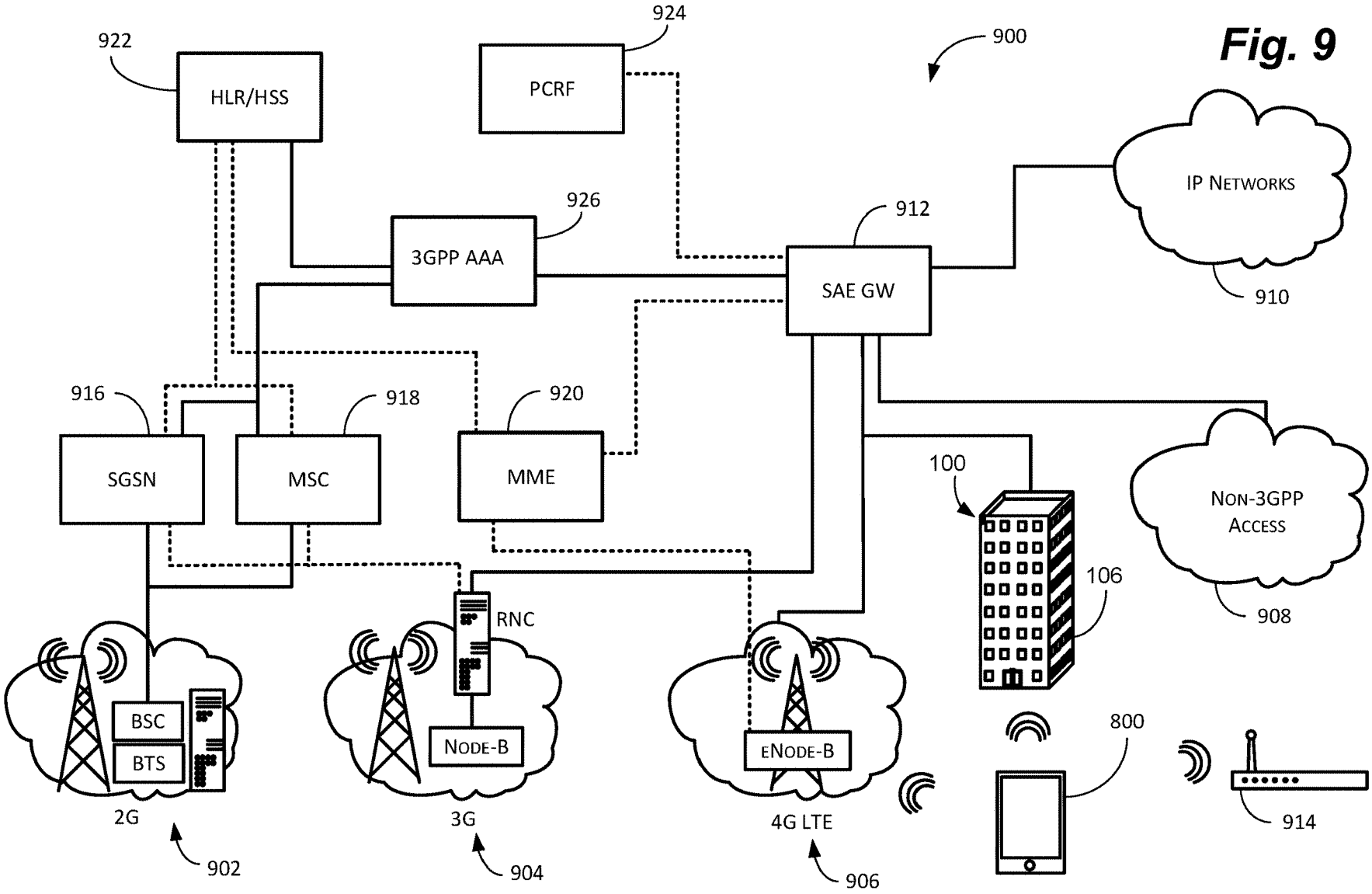
FIG. 9 is an example of a cellular network in communication with the system, in accordance with some examples of the present disclosure.

As shown in FIG. 9, the system 100, 500 can be used in conjunction with a number of wireless communications networks. As mentioned above, the system 100, 500 described herein can be used to supplement throughput in areas of high demand where conventional cell towers, or "macro" cells, cannot practically be installed. As shown, the system 100 can be connected to the cellular backbone in a suitable manner to provide localized throughput to users in a compact, cost-effective, targeted manner. To this end, FIG. 9 depicts a conventional cellular network 900 including 2G 902, 3G 904, and 4G long-term evolution (LTE) network 906 components. Of course, future technologies, such as, for example, 5G and device-to-device (D2D) components could also be included and are contemplated herein.

As is known in the art, data can be routed from the Internet or other sources using a circuit switched modem connection (or non-3GPP connection) 908, which provides relatively low data rates, or via IP network 910 (packet switched) connections, which results is higher throughput. The LTE network 906, which is purely IP based, essentially "flattens" the architecture, with data going straight from the internet to the service architecture evolution gateway (SAE GW) 912 to evolved Node B (LTE system 906) transceivers, enabling higher throughput. Many electronic devices 800 also have wireless local area network (WLAN) 914 capabilities, in some cases enabling even higher throughput. In some cases, cellular carriers may use WLAN communications in addition to, or instead of, cellular communications to supplement throughput.

The serving GPRS support node (SGSN) 916 is a main component of the general packet radio service (GPRS) network, which handles all packet switched data within the network 900—e.g. the mobility management and authentication of the users. The MSC 918 essentially performs the same functions as the SGSN 916 for voice traffic. The MSC 918 is the primary service delivery node for global system for mobile communication (GSM) and code division multiple access (CDMA), responsible for routing voice calls and short messaging service (SMS) messages, as well as other services (such as conference calls, fax, and circuit switched data). The MSC 918 sets up and releases the end-to-end connection, handles mobility and hand-over requirements during the call, and takes care of charging and real time pre-paid account monitoring.

Similarly, the mobility management entity (MME) 920 is the key control-node for the 4G LTE network 906. It is responsible for idle mode electronic device 800 paging and tagging procedures including retransmissions. The MME 920 is involved in the bearer activation/deactivation process and is also responsible for choosing the SAE GW 912 for the electronic device 800 at the initial attach and at time of intra-LTE handover involving Core Network (CN) node relocation (i.e., switching from one cell tower to the next when traveling). The MME 920 is responsible for authenticating the user (by interacting with the HSS 922 discussed below). The Non-Access Stratum (NAS) signaling terminates at the MME 920 and it is also responsible for generation and allocation of temporary identities to the electronic device 800. The MME 920 also checks the authorization of the electronic device 800 to camp on the service provider's HPLMN or VPLMN and enforces electronic device 800 roaming restrictions on the VPLMN. The MME 920 is the termination point in the network for ciphering/integrity protection for NAS signaling and handles the security key management. The MME 920 also provides the control plane function for mobility between LTE network 906 and 2G 902/3G 904 access networks with the S3 interface terminating at the MME 920 from the SGSN 916. The MME 920 also terminates the S6*a* interface towards the home HSS 922 for roaming electronic device 800.

The HSS/HLR 922 is a central database that contains user-related and subscription-related information. The functions of the HSS/HLR 922 include functionalities such as mobility management, call and session establishment support, user authentication and access authorization. The HSS, which is used for LTE connections, is based on the previous HLR and Authentication Center (AuC) from CGMA and GSM technologies, with each serving substantially the same functions for their respective networks.

The policy and charging rules unction (PCRF) 924 is a software node that determines policy rules in the network 900. The PCRF 924 is generally operates at the network core and accesses subscriber databases (e.g., the HSS/HLR 922) and other specialized functions in a centralized manner. The PCRF 924 is the main part of the network 900 that aggregates information to and from the network 900 and other sources (e.g., IP networks 910). The PCRF 924 can support the creation of rules and then can automatically make policy decisions for each subscriber active on the network 900. The PCRF 924 can also be integrated with different platforms like billing, rating, charging, and subscriber database or can also be deployed as a standalone entity.

Finally, the 3GPP AAA server 926 performs authentication, authorization, and accounting (AAA) functions and may also act as an AAA proxy server. For WLAN 914 access to (3GPP) IP networks 910 the 3GPP AAA Server 926 provides authorization, policy enforcement, and routing information to various WLAN components. The 3GPP AAA Server 926 can generate and report charging/accounting information, performs offline charging control for the WLAN 914, and perform various protocol conversions when necessary.

While several possible examples are disclosed above, examples of the present disclosure are not so limited. For instance, while the systems and methods above are discussed with reference to use with cellular communications, the systems and methods can be used with other types of wired and wireless communications. In addition, while various components (e.g., the tilting mechanism 504) are discussed, other components could perform the same or similar functions without departing from the spirit of the invention.

The specific configurations, machines, and the size and shape of various elements can be varied according to particular design specifications or constraints requiring a low-profile end-fire antenna 110, positioning stand 302, or other component constructed according to the principles of this disclosure. Such changes are intended to be embraced within the scope of this disclosure. The presently disclosed examples, therefore, are considered in all respects to be illustrative and not restrictive. The scope of the disclosure is indicated by the appended claims, rather than the foregoing description, and all changes that come within the meaning and range of equivalents thereof are intended to be embraced therein.

What is claimed is:

1. A low-profile end-fire antenna system comprising:

a case;

a ground plane, detachably coupled to the case, with a lateral axis and a longitudinal axis;

a plurality of radiating elements disposed on the ground plane parallel to the lateral axis at a predetermined spacing to cause a direction of maximum radiation parallel to the longitudinal axis;

a phase shifter, in communication with the plurality of radiating elements, to cause the plurality of radiating elements to radiate in an alternating out-of-phase pattern; and a controller communicatively coupled to the phase shifter, the controller configured to cause the phase shifter to adjust phase of the plurality of radiating elements.

2. The system of claim 1, further comprising:

a radome detachably coupled to the case in an overlying manner to the ground plane and sized and shaped to shed water and debris; and one or more radio frequency (RF) connectors to connect the system to an RF transceiver.

3. The system of claim 2, wherein the radome is pyramid shaped to shed water and debris off the system.

4. The system of claim 3, wherein a front face of the pyramid, disposed in the direction of maximum radiation, includes a lens to steer the direction of maximum radiation in a direction that is not parallel to the longitudinal axis.

5. The system of claim 1, further comprising:

a duplexer, in communication with the one or more RF connectors, to filter out one or more frequencies and mounted remotely to the low-profile end-fire antenna to reduce a profile of the low-profile end-fire antenna when compared to an antenna with an integral duplexer.

6. The system of claim 1, wherein the phase shifter is mounted remotely to the low-profile end-fire antenna to reduce a profile of the low-profile end-fire antenna when compared to an antenna with an integral phase shifter.

7. The system of claim 1, wherein the ground plane is disposed parallel to a bottom surface of the case.

8. The system of claim 1, further comprising:

a positioning stand to support and aim the low-profile end-fire antenna, the positioning stand comprising:

a tilting mechanism to change an elevation of the low-profile end-fire antenna; and a front support pivotally coupled to a mounting location to enable an azimuth of the low-profile end-fire antenna to be changed.

9. The system of claim 8, wherein the positioning stand further comprises a weather-resistant enclosure.

10. A system for providing low-profile end-fire antennas on a structure, the system comprising:

a first low-profile end-fire antenna comprising:

a first case;

a first ground plane, detachably coupled to the first case, with a lateral axis and a longitudinal axis;

a first plurality of radiating elements, sized and shaped to resonate at least a first frequency, the first plurality of radiating elements disposed on the first ground plane parallel to the lateral axis of the first ground plane at a predetermined spacing to cause a direction of maximum radiation from the first antenna that is parallel to the longitudinal axis;

a first radome detachably coupled to the first case in an overlying manner to the first ground plane and sized and shaped to shed water and debris; and a first plurality of radio frequency (RF) connectors to connect the first antenna to an RF transceiver;

a second low-profile end-fire antenna comprising:

a second case;

a second ground plane, detachably coupled to the second case, with a lateral axis and a longitudinal axis;

a second plurality of radiating elements, sized and shaped to resonate at least a second frequency, the second plurality of radiating elements disposed on the second ground plane parallel to the lateral axis of the second ground plane at a predetermined spacing to cause a direction of maximum radiation from the second antenna that is parallel to the longitudinal axis;

a second radome detachably coupled to the second case in an overlying manner to the second ground plane and sized and shaped to shed water and debris; and a second plurality of RF connectors to connect the second antenna to an RF transceiver;

a duplexer in communication with the first antenna and second antenna to filter out at least one unwanted frequency; and a phase shifter, in communication with the first antenna and second antenna to cause the first plurality of radiating elements and the second plurality of radiating elements to radiate in an alternating out-of-phase pattern, wherein one of the first frequency or the second frequency is associated with cellular communications uplink frequencies, and wherein the other of the first frequency or the second frequency is associated with cellular communications downlink frequencies.

11. The system of claim 10, wherein the duplexer is mounted remotely to the first antenna and second antenna to reduce a profile of the first antenna and second antenna when compared to an antenna with an integral duplexer.

12. The system of claim 10, wherein the phase shifter is mounted remotely to the first antenna and second antenna to reduce a profile of the first antenna and second antenna when compared to an antenna with an integral phase shifter.

13. The system of claim 10, wherein the first low-profile end-fire antenna further comprising:

a positioning stand to support and aim the first low-profile end-fire antenna, the positioning stand comprising:

a front support, detachably coupled to a first end of the first low-profile end-fire antenna, the front support pivotally coupled the structure to enable an azimuth of the first low-profile end-fire antenna to be changed; and a tilting mechanism coupled to a second end of the first low-profile end-fire antenna to change an elevation of the first low-profile end-fire antenna.

14. The system of claim 13, the positioning stand further comprising:

a weather resistant enclosure to house at least the duplexer and phase-shifter.

15. The system of claim 13, further comprising a controller in communication with at least the tilting mechanism to enable the elevation of the first low-profile end-fire antenna to be changed, from a first position to a second position, from a location that is remote to the first low-profile end-fire antenna.

16. The system of claim 15, wherein the controller is further in communication with the phase shifter to adjust phase of the first plurality of radiating elements and the second plurality of radiating elements.

17. A system for providing low-profile end-fire antennas on a structure, the system comprising:

a first low-profile end-fire antenna comprising:

a first case;

a first ground plane, detachably coupled to the first case, with a lateral axis and a longitudinal axis;

a first plurality of radiating elements, sized and shaped to resonate at least a first frequency, the first plurality of radiating elements disposed on the first ground plane parallel to the lateral axis of the first ground plane at a predetermined spacing to cause a direction of maximum radiation from the first antenna that is parallel to the longitudinal axis;

a first radome detachably coupled to the first case in an overlying manner to the first ground plane and sized and shaped to shed water and debris;

a first plurality of radio frequency (RF) connectors to connect the first antenna to an RF transceiver; and a positioning stand to support and aim the first low-profile end-fire antenna, the positioning stand comprising:

a front support, detachably coupled to a first end of the first low-profile end-fire antenna, the front support pivotally coupled the structure to enable an azimuth of the first low-profile end-fire antenna to be changed; and a tilting mechanism coupled to a second end of the first low-profile end-fire antenna to change an elevation of the first low-profile end-fire antenna;

a second low-profile end-fire antenna comprising:

a second case;

a second ground plane, detachably coupled to the second case, with a lateral axis and a longitudinal axis;

a second plurality of radiating elements, sized and shaped to resonate at least a second frequency, the second plurality of radiating elements disposed on the second ground plane parallel to the lateral axis of the second ground plane at a predetermined spacing to cause a direction of maximum radiation from the second antenna that is parallel to the longitudinal axis;

a second radome detachably coupled to the second case in an overlying manner to the second ground plane and sized and shaped to shed water and debris; and a second plurality of RF connectors to connect the second antenna to an RF transceiver;

a duplexer in communication with the first antenna and second antenna to filter out at least one unwanted frequency; and a phase shifter, in communication with the first antenna and second antenna to cause the first plurality of radiating elements and the second plurality of radiating elements to radiate in an alternating out-of-phase pattern.

18. The system of claim 17, wherein one of the first frequency or the second frequency is associated with cellular communications uplink frequencies, and wherein the other of the first frequency or the second frequency is associated with cellular communications downlink frequencies.

19. The system of claim 17, further comprising:

a controller, in communication with at least the tilting mechanism, to enable the elevation of the first low-profile end-fire antenna to be changed, from a first position to a second position, from a location that is remote to the first low-profile end-fire antenna.

20. The system of claim 19, wherein the positioning stand further comprises a weather-resistant enclosure to house at least the controller, duplexer, and phase shifter.

* * * * *